US010235927B2

(12) United States Patent
Li et al.

(10) Patent No.: US 10,235,927 B2
(45) Date of Patent: Mar. 19, 2019

(54) ON-CHIP CLOCK CALIBRATION SYSTEMS AND METHODS FOR ELECTRONIC DEVICE DISPLAYS

(71) Applicant: Apple Inc., Cupertino, CA (US)

(72) Inventors: Haifeng Li, Campbell, CA (US); Kingsuk Brahma, Mountain View, CA (US); Yafei Bi, Palo Alto, CA (US)

(73) Assignee: Apple Inc., Cupertino, CA (US)

( * ) Notice: Subject to any disclaimer, the term of this patent is extended or adjusted under 35 U.S.C. 154(b) by 182 days.

(21) Appl. No.: 15/367,143

(22) Filed: Dec. 1, 2016

(65) Prior Publication Data

US 2018/0061305 A1 Mar. 1, 2018

Related U.S. Application Data

(60) Provisional application No. 62/380,336, filed on Aug. 26, 2016.

(51) Int. Cl.
*G09G 3/36* (2006.01)
*G09G 3/20* (2006.01)

(52) U.S. Cl.
CPC ..... *G09G 3/2092* (2013.01); *G09G 3/20* (2013.01); *G09G 2300/08* (2013.01); *G09G 2310/061* (2013.01); *G09G 2310/08* (2013.01); *G09G 2320/0693* (2013.01)

(58) Field of Classification Search
CPC .... G09G 3/20; G09G 3/2092; G09G 2300/08; G09G 2310/061; G09G 2310/08; G09G 2320/0693; G09G 3/3225; G09G 3/3648; G09G 2320/0285; G09G 2320/029
See application file for complete search history.

(56) References Cited

U.S. PATENT DOCUMENTS

2010/0253647 A1* 10/2010 Agari ..... G06F 3/0416 345/174
2013/0328852 A1* 12/2013 Jamal ..... G09G 3/3225 345/212
2017/0089975 A1* 3/2017 Savoj ..... G01R 31/2874

* cited by examiner

*Primary Examiner* — Nelson M Rosario
(74) *Attorney, Agent, or Firm* — Morgan, Lewis & Bockius LLP

(57) ABSTRACT

Aspects of the subject technology relate to electronic devices with displays. A display may include display control circuitry including an internal oscillator and one or more counters. The counters may be used to calibrate a display line time to a system line time to ensure that each displayed frame is synchronized with received display data frames from system circuitry for the electronic device. The counters may include a first counter that maintains a current-row count during operation of a current row of display pixels during a current display frame and a second counter that maintains a current-frame count that indicates a number of counts accumulated during the current display frame. The current-row count and the current-frame count may be referenced to the system line time during operation of each pixel row to remove any errors accumulated during operation of the previous pixel rows.

20 Claims, 8 Drawing Sheets

ON-CHIP CLOCK CALIBRATION SYSTEMS AND METHODS FOR ELECTRONIC DEVICE DISPLAYS

CROSS-REFERENCE TO RELATED APPLICATIONS

The present application claims the benefit of priority under 35 U.S.C. § 119 as a non-provisional of U.S. Provisional Patent Application Ser. No. 62/380,336 entitled "On-Chip Clock Calibration Systems and Methods for Electronic Device Displays" and filed on Aug. 26, 2016, the disclosure of which is hereby incorporated by reference in its entirety for all purposes.

TECHNICAL FIELD

The present description relates generally to electronic devices with displays, and more particularly, but not exclusively, to systems and methods for calibrated display control signal timing.

BACKGROUND

Electronic devices such as computers, media players, cellular telephones, set-top boxes, and other electronic equipment are often provided with displays for displaying visual information. Displays such as organic light-emitting diode (OLED) displays and liquid crystal displays typically include an array of display pixels arranged in pixel rows and pixel columns. Display control circuitry coupled to the array of display pixels typically receives data for display from system control circuitry of the electronic device and, based on the data for display, generates and provides control signals for the pixel rows and pixel columns. However, it can be challenging to coordinate the timing of the provided data for display with the timing of the control signals for the pixel rows and pixel columns.

SUMMARY

An electronic device may include a display having an array of display pixels. The electronic device may include system control circuitry such as storage and processing circuitry that generates display data for the display. Display control circuitry such as a display driver integrated circuit (IC) may receive the display data from the storage and processing circuitry.

Based on the received display data, the display control circuitry may generate and provide control signals to pixel rows and pixel columns of the array of display pixels. The provided control signals may include display data signals provided, on a row-by-row basis to the pixels in each pixel column. The provided control signals may include a horizontal synch (HSYNC) signal that signals the end of each pixel row. The display control circuitry may be configured to provide the HSYNC signal with a desired frequency so that each pixel row is operated for a desired amount of time (sometimes referred to herein as a display 1H time) and so that a display frame has a desired frame time.

However, the display data provided by the storage and processing circuitry may be provided in display rows with a row frequency that differs from the desired row frequency of the display. For example, in various scenarios, the data for each pixel row may be provided from the storage and processing circuitry with a system line time (sometimes referred to herein as a system 1H time) that is shorter than the display 1H time. For example, providing the data for each pixel row over a system 1H time that is shorter than the display 1H time, may allow for a longer vertical blanking period within which the storage and processing circuitry can perform data processing operations between each display frame.

In order to provide a calibrated display 1H time, regardless of the system 1H time, and to ensure that the end and beginning of each display data frame from the storage and processing circuitry coincides with the corresponding end and beginning of each display frame of the display, the display control circuitry may be provided with an internal oscillator. In this way, the display 1H timing can be decoupled from the system timing.

In order to provide additional timing control accuracy (e.g., to reduce potential errors related to temperature-induced oscillator frequency changes), the display control circuitry may be provided with one or more counting circuits (referred to herein as counters) that count, based on a clock signal from the internal oscillator, a number of counts since the beginning of each pixel row and/or a number of counts since the beginning of each display frame, which can be referenced to a system line time to obtain a reference count for each pixel row and/or a reference count for an entire frame. The reference count for each pixel row and/or the reference count for the entire frame may be used to correct the number of counts for a current pixel row, in real time. In this way, errors associated with uncertainty in the internal oscillator signal and/or the counters can be reduced to, for example, less than the 1H time of a single pixel row.

In accordance with various aspects of the subject disclosure, an electronic device is provided having a display having an array of display pixels arranged in pixel rows and pixel columns. The electronic device may include display control circuitry configured to operate the array of display pixels to display a plurality of display frames. The display control circuitry may include an internal oscillator. The display control circuitry may also include a first counter configured to maintain, based on an output of the internal oscillator, a current-row count during operation of a current one of the pixel rows for a current display frame. The display control circuitry may also include a second counter configured to maintain, based on the output of the internal oscillator, a current-frame count during operation of all of the pixel rows for the current display frame.

In accordance with other aspects of the subject disclosure, a display controller for controlling an array of display pixels, arranged in pixel rows and pixel columns, to display a plurality of display frames may be provided. The display controller may include an internal oscillator. The display controller may also include a first counter configured to maintain, based on an output of the internal oscillator, a current-row count during operation of a current one of the pixel rows for a current display frame. The display controller may also include a second counter configured to maintain, based on the output of the internal oscillator, a current-frame count during operation of all of the pixel rows for the current display frame.

In accordance with other aspects of the subject disclosure, a method is provided that includes operating an array of display pixels arranged in pixel rows and pixel columns to display a current display frame, based on display data having a system line time. The method may also include maintaining, while operating a current pixel row of the array of display pixels during the current display frame, a current-row count that indicates an accumulated number of counts since a beginning of the operation of the current pixel row.

The method may also include maintaining, while operating the current pixel row, a current-frame count that indicates an accumulated number of counts since a beginning of the operation of the current display frame. The method may also include determining, while operating the current pixel row, an actual completed-row count that indicates a number of counts accumulated while operating all previous pixel rows during the current display frame. The method may also include determining, while operating the current pixel row, a reference current-row count based on the current-row count and the system line time. The method may also include determining, while operating the current pixel row and based on the system line time, a reference completed-row count that indicates an expected number of counts accumulated while operating all previous pixel rows during the current display frame. The method may also include determining a corrected reference current-row count based on the reference current-row count, the actual completed-row count, and the reference completed-row count. The method may also include and completing operation of the current pixel row and beginning operation of a subsequent pixel row based on the corrected reference current-row count.

It is understood that other configurations of the subject technology will become readily apparent to those skilled in the art from the following detailed description, wherein various configurations of the subject technology are shown and described by way of illustration. As will be realized, the subject technology is capable of other and different configurations and its several details are capable of modification in various other respects, all without departing from the scope of the subject technology. Accordingly, the drawings and detailed description are to be regarded as illustrative in nature and not as restrictive.

BRIEF DESCRIPTION OF THE DRAWINGS

Certain features of the subject technology are set forth in the appended claims. However, for purpose of explanation, several embodiments of the subject technology are set forth in the following figures.

DETAILED DESCRIPTION

The detailed description set forth below is intended as a description of various configurations of the subject technology and is not intended to represent the only configurations in which the subject technology may be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and may be practiced without these specific details. In some instances, well-known structures and components are shown in block diagram form in order to avoid obscuring the concepts of the subject technology.

The subject disclosure provides electronic devices such as cellular telephones, media players, computers, set-top boxes, wireless access points, and other electronic equipment that may include displays. Displays may be used to present visual information and status data and/or may be used to gather user input data. A display may include an array of display pixels. Each display pixel may include one or more colored subpixels for displaying color images.

An electronic device having a display may include storage and processing circuitry and display control circuitry for controlling operation of the display. The storage and processing circuitry may generate display data for the display. The display control circuitry may receive the display data from the storage and processing circuitry and may provide corresponding pixel control signals to the display.

In some electronic devices, a system 1H time for each row of display data provided from the storage and processing circuitry may be different from display 1H time for operating the pixels of a corresponding row to display the provided display date. For example, storage and processing circuitry may generate display data with a system 1H time that is shorter than the display 1H time so that additional data processing for each display frame can be performed in a relatively longer vertical blanking period, as described in further detail hereinafter.

An electronic device may calibrate the display 1H time to the system 1H time to ensure that each frame of the provided display data is in sync with the display of that frame using the pixel array. For example, the display control circuitry may include an internal oscillator and one or more counters to calibrate the display 1H time to the system 1H time. An illustrative electronic device of the type that may be provided with a display having display control circuitry with an internal oscillator and one or more counters is shown in FIG. 1.

Figure 1:
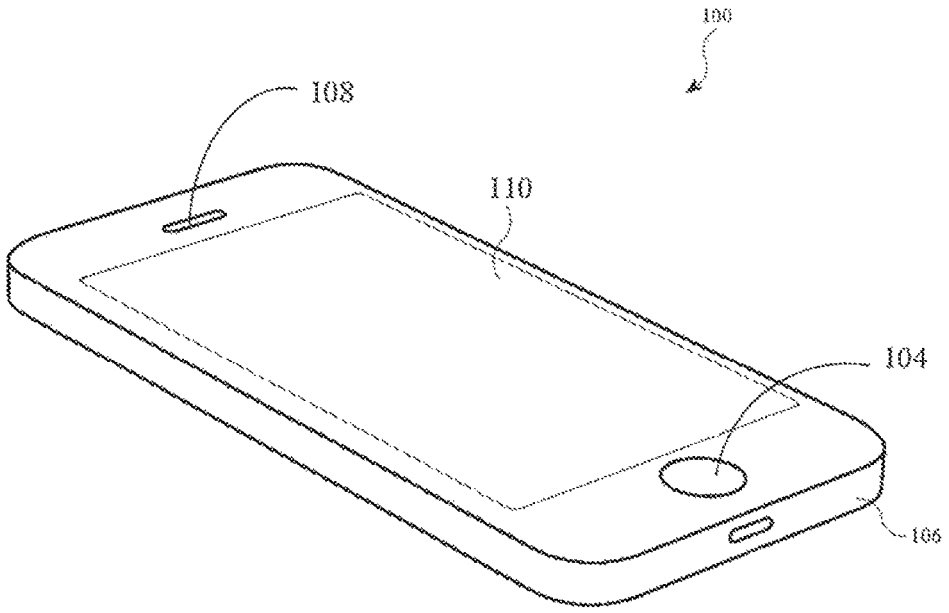
FIG. 1 illustrates a perspective view of an example electronic device implemented as a cellular telephone having a display in accordance with various aspects of the subject technology.

In the example of FIG. 1, device 100 has been implemented using a housing that is sufficiently small to fit within a user's hand (e.g., device 100 of FIG. 1 may be a handheld electronic device such as a cellular telephone). As show in FIG. 1, device 100 may include a display such as display 110 mounted on the front of housing 106. Display 110 may be substantially filled with active display pixels or may have an active portion and an inactive portion. Display 110 may have openings (e.g., openings in the inactive or active portions of display 110) such as an opening to accommodate button 104 and an opening to accommodate speaker port 108.

Display 110 may be a touch screen that incorporates capacitive touch electrodes or other touch sensor components or may be a display that is not touch-sensitive. Display 110 may include display pixels formed from light-emitting diodes (LEDs), organic light-emitting diodes (OLEDs), plasma cells, electrophoretic display elements, electrowetting display elements, liquid crystal display (LCD) components, or other suitable display pixel structures. Arrangements in which display 110 is formed using organic light-emitting diode pixels are sometimes described herein as an example. This is, however, merely illustrative. In various implementations, any suitable type of display technology may be used in forming display 110 if desired.

Housing 106, which may sometimes be referred to as a case, may be formed of plastic, glass, ceramics, fiber composites, metal (e.g., stainless steel, aluminum, etc.), other suitable materials, or a combination of any two or more of these materials.

The configuration of electronic device 100 of FIG. 1 is merely illustrative. In other implementations, electronic device 100 may be a computer such as a computer that is integrated into a display such as a computer monitor, a laptop computer, a tablet computer, a somewhat smaller portable device such as a wrist-watch device, pendant device, or other wearable or miniature device, a media player, a gaming device, a navigation device, a computer monitor, a television, or other electronic equipment.

Figure 2:
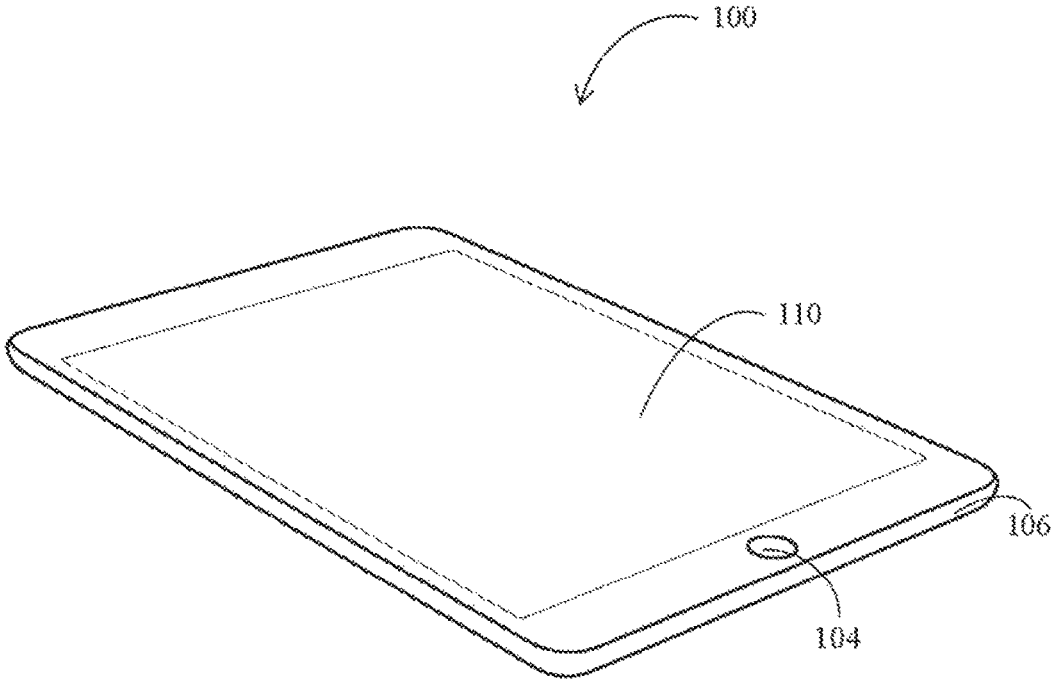
FIG. 2 illustrates a perspective view of an example electronic device implemented as a tablet computer having a display in accordance with various aspects of the subject technology.

For example, FIG. 2 is a perspective view of electronic device 100 in a configuration in which electronic device 100 has been implemented in the form of a tablet computer. As shown in FIG. 2, display 110 may be mounted on the upper (front) surface of housing 106. An opening may be formed in display 110 to accommodate button 104.

Figure 3:
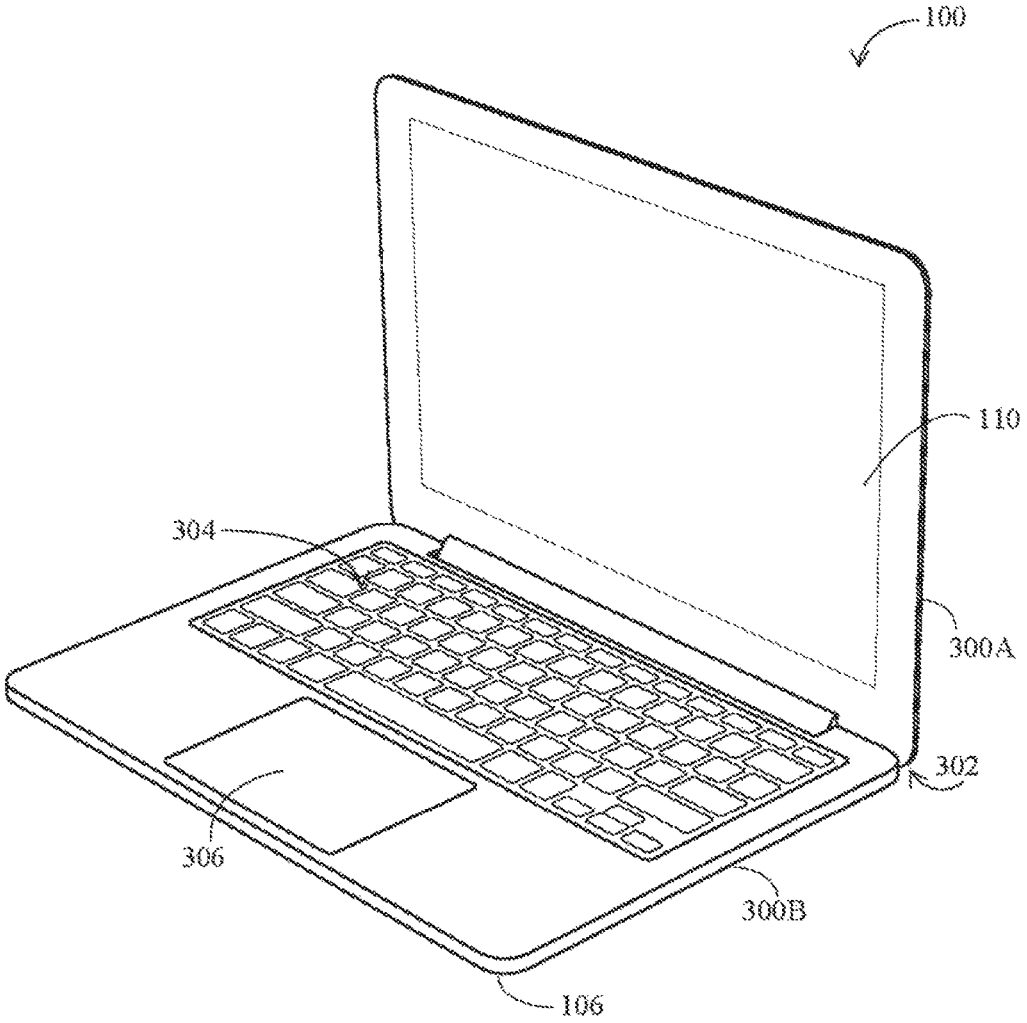
FIG. 3 illustrates a perspective view of an example electronic device implemented as a portable computer having a display in accordance with various aspects of the subject technology.

As another example, FIG. 3 is a perspective view of electronic device 100 in a configuration in which electronic device 100 has been implemented in the form of a portable computer. In the example of FIG. 3, housing 106 may be formed using a unibody configuration in which some or all of housing 106 is machined or molded as a single structure or may be formed using multiple structures (e.g., an internal frame structure, one or more structures that form exterior housing surfaces, etc.).

As shown in FIG. 3, housing 106 may have multiple parts. For example, housing 106 may have upper portion 300A and lower portion 300B. Upper portion 300A may be coupled to lower portion 300B using a hinge that allows portion 300A to rotate about rotational axis 302 relative to portion 300B. A keyboard such as keyboard 304 and a touch pad such as touch pad 306 may be mounted in lower housing portion 302B, in some implementations.

Figure 4:
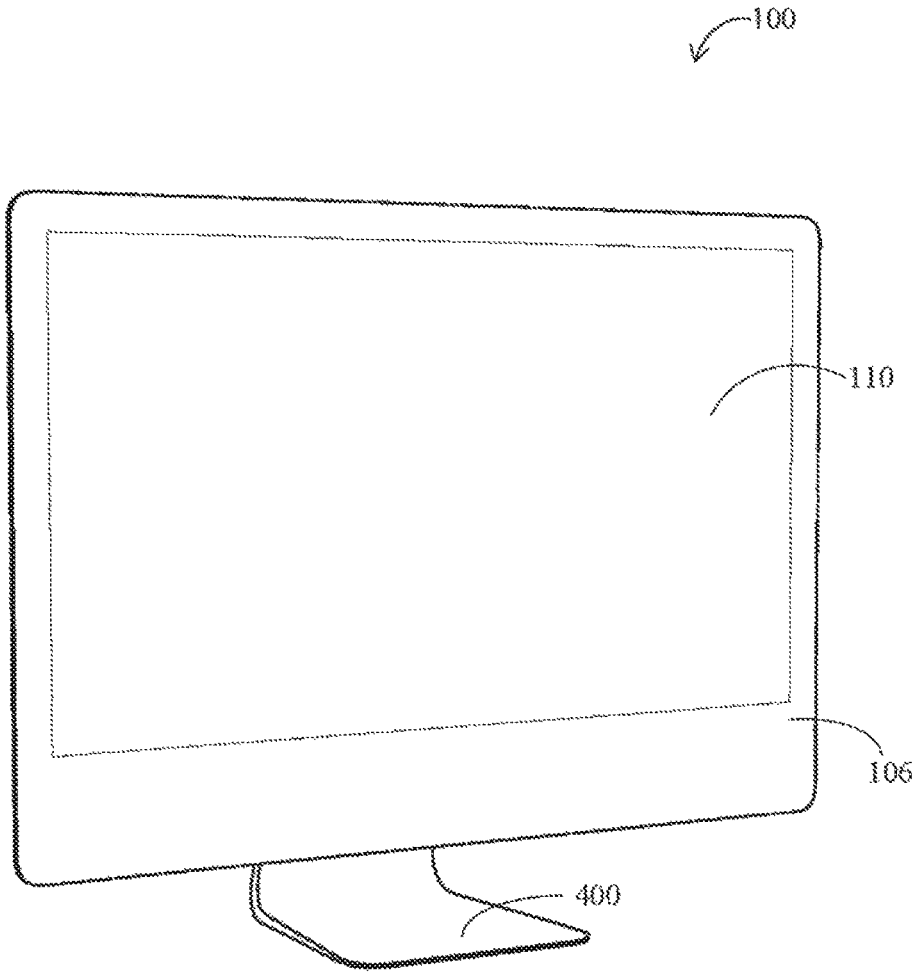
FIG. 4 illustrates a perspective view of an example electronic device implemented as a computer monitor with a built-in computer having a display in accordance with various aspects of the subject technology.

FIG. 4 is a perspective view of electronic device 100 in a configuration in which electronic device 100 has been implemented in the form of a computer integrated into a computer monitor. As shown in FIG. 4, display 110 may be mounted on a front surface of housing 106. Stand 400 may be used to support housing 106.

Figure 5:
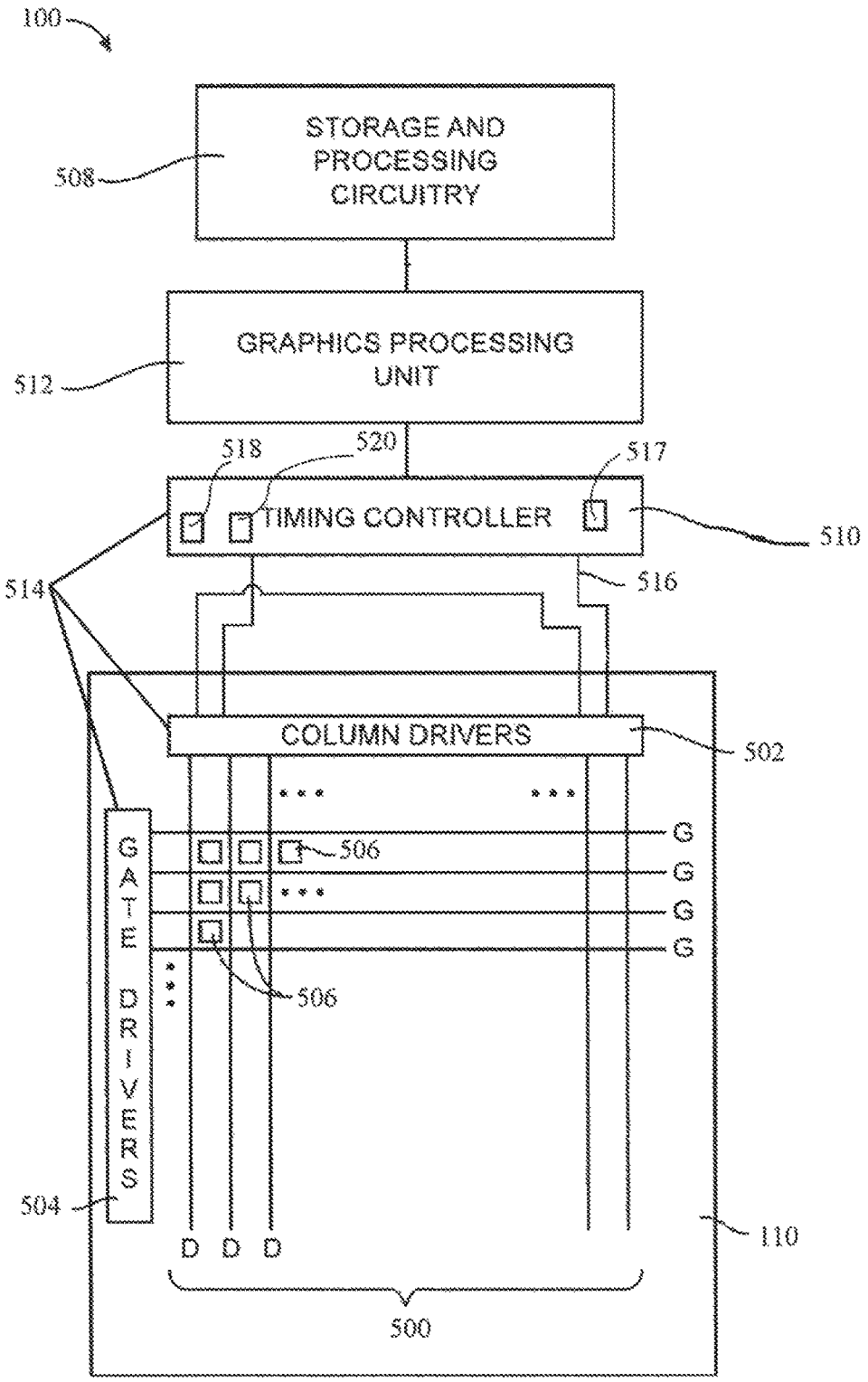
FIG. 5 illustrates a schematic diagram of an exemplary electronic device having a display in accordance with various aspects of the subject technology.

FIG. 5 is a schematic diagram of device 100 showing illustrative circuitry that may be used in displaying images for a user of device 100 on pixel array 500 of display 110. As shown in FIG. 5, display 110 may include column driver circuitry 502 that drives data signals (analog voltages) onto the data lines D of array 500. Gate driver circuitry 504 may drive gate line signals onto gate lines G of array 500.

Using the data lines D and gate lines G, display pixels 506 may be operated to display images on display 110 for a user. In some implementations, gate driver circuitry 504 may be implemented using thin-film transistor circuitry on a display substrate such as a glass or plastic display substrate or may be implemented using integrated circuits that are mounted on the display substrate or attached to the display substrate by a flexible printed circuit or other connecting layer. In some implementations, column driver circuitry 502 may be implemented using one or more column driver integrated circuits that are mounted on the display substrate or using column driver circuits mounted on other substrates.

Device 100 may include storage and processing circuitry 508. Storage and processing circuitry 508 may include one or more different types of storage such as hard disk drive storage, nonvolatile memory (e.g., flash memory or other electrically-programmable-read-only memory), volatile memory (e.g., static or dynamic random-access-memory), magnetic or optical storage, permanent or removable storage and/or other non-transitory storage media configure to store static data, dynamic data, and/or computer readable instructions for processing circuitry in storage and processing circuitry 508. Processing circuitry in storage and processing circuitry 508 may be used in controlling the operation of device 100. Processing circuitry in storage and processing circuitry 508 may sometimes be referred to herein as system circuitry or a system-on-chip (SOC) for device 100.

The processing circuitry may be based on a processor such as a microprocessor and other suitable integrated circuits, multi-core processors, one or more application specific integrated circuits (ASICs) or field programmable gate arrays (FPGAs) that execute sequences of instructions or code, as examples. In one suitable arrangement, storage and processing circuitry 508 may be used to run software for device 100, such as internet browsing applications, email applications, media playback applications, operating system functions, software for capturing and processing images, software implementing functions associated with gathering and processing sensor data, software that makes adjustments to display brightness and touch sensor functionality, etc.

During operation of device 100, storage and processing circuitry 508 may produce data that is to be displayed on display 110. This display data may be provided to display control circuitry such as timing controller integrated circuit 510 using graphics processing unit 512.

Timing controller 510 may provide digital display data to column driver circuitry 502 using paths 516. Column driver circuitry 502 may receive the digital display data from timing controller 510. Using digital-to-analog converter circuitry within column driver circuitry 502, column driver circuitry 502 may provide corresponding analog output signals on the data lines D running along the columns of display pixels 506 of array 500.

Timing controller 510, column drivers 502, and gate drivers 504 may sometimes collectively be referred to herein as display control circuitry 514. Display control circuitry 514 may be used in controlling the operation of display 110. Display control circuitry 514 may be implemented, in some configurations, in a common package such as a display driver, a display controller, a display driver integrated circuit (IC), or a driver IC. Graphics processing unit 512 may perform image or other graphics processing on display data received from storage and processing circuitry 508 prior to providing the display data to display control circuitry 514 for display using pixels 506 of array 500. Graphics processing unit 512 may be a separate processing controller from system circuitry associated with storage and processing circuitry 508 or may be implemented as a part of storage and processing circuitry 508 (e.g., in a common SOC).

For example, display control circuitry 514 (e.g., timing controller 510) may include an internal oscillator 517 that generates a clock signal for display control circuitry 514 and one or more counters such as counters 518 and 520. Although internal (local) oscillator 517 and counters such as counters 518 and 520 are shown as being implemented in timing control 510, this is merely illustrative and, in other implementations, internal (local) oscillator 517 and counters such as counters 518 and 520 may be implemented separately from timing control 510 within display control circuitry 514. Counter 518 may maintain, during operation of each pixel row in array 500 by gate driver 504, a current-row count that indicates an accumulated number of counts since the beginning of the operation of that pixel row. Counter 520 may maintain, during operations of all pixel rows in array 500 by gate driver 504 during each display frame, a current-frame count that indicates an accumulated number of counts since the beginning of the display frame, as described in further detail with respect to, for example, FIGS. 6 and 7.

A display frame may be defined by an interval between display refresh events and may include operation of all active pixels 506 in array 500 (e.g., by operating each pixel row in array 500 with gate driver 504 in cooperation with each pixel column in array 500 with column driver 502). Display data for each display frame may be provided to display control circuitry 514 by storage and processing circuitry 508 and/or graphics processing unit 512 (e.g., using a system 1H time for the display data for each pixel row). Display control circuitry 514 may operate pixels 506 of pixel array 500 to display the provided display data (e.g., using a display 1H time for the display data for each pixel row).

Figure 6:
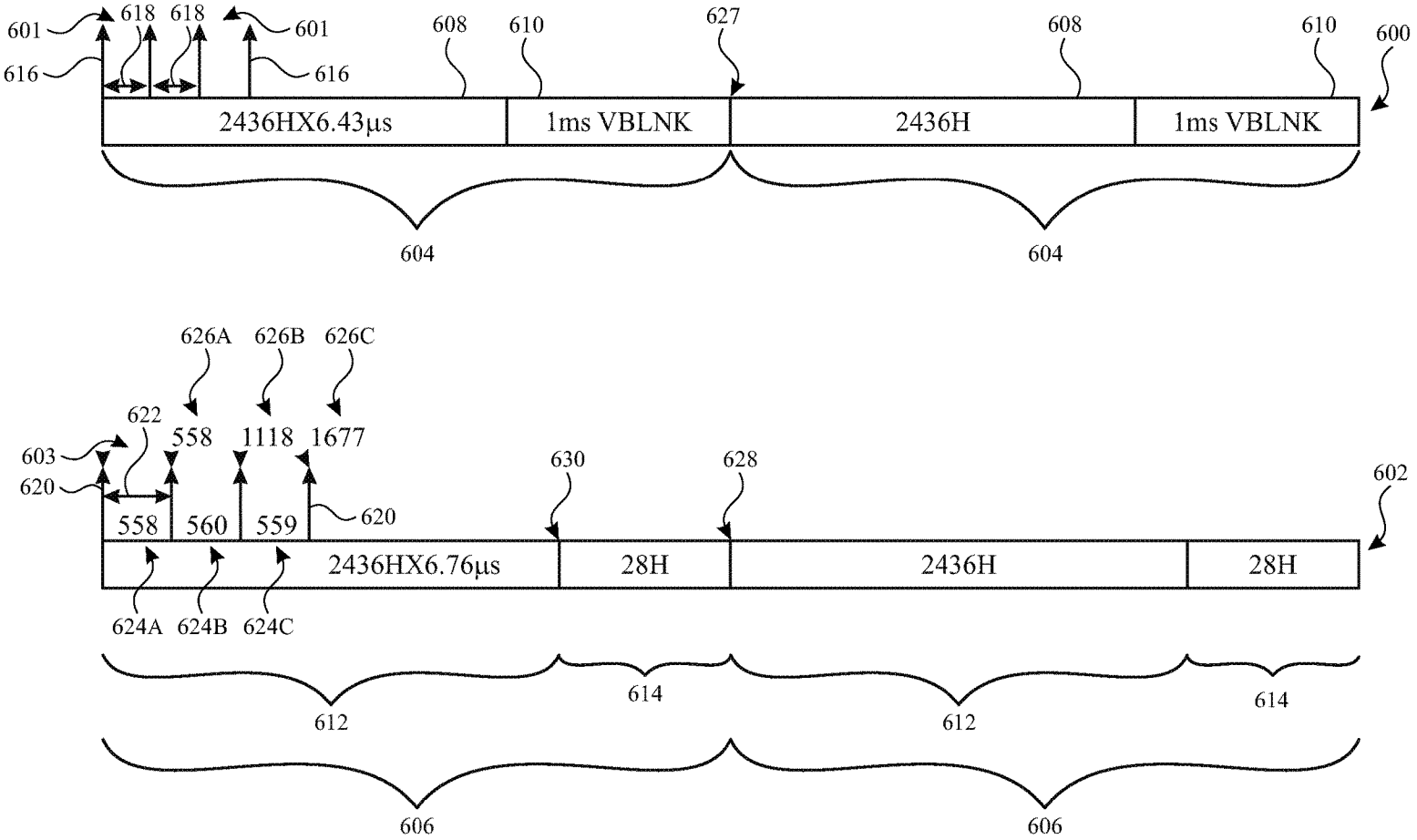
FIG. 6 illustrates a diagram of system timing and display timing in accordance with various aspects of the subject technology.

FIG. 6 shows a representation of two consecutive display data frames of a portion of a system or SOC timeline 600 and two consecutive display frames of a portion of a display timeline 602. As shown in FIG. 6, display data frames 604 in system timeline 600 may each include a data transmission portion 608 and a vertical blanking interval 610. The system 1H time 618 corresponding to each display data pixel row 601 for the data transmission portion 608 of each display data frame 604 may be defined as the interval between system horizontal synchronization signals 616. Vertical blanking periods 610 of each display data frame 604 may be used, for example, by storage and processing circuitry 508 for processing of display data for a subsequent display data frame. In the example of FIG. 6, the system 1H time or system line time is 6.43 microseconds, the vertical blanking period is 1 millisecond, and pixel array 500 includes 2436 pixel rows with the internal oscillator operating at a frequency of 82.7 megahertz. However, this is merely illustrative and other array sizes, system 1H times, frequencies, and vertical blanking periods can be used as would be understood by one of ordinary skill in the art.

Display data for each display data frame 604 may be displayed using display 110 in a corresponding display frame 606 having a data display period 612 and a vertical blanking interval 614. Display control circuitry 514 may operate internal oscillator 517 and/or one or more of counters 518 and 520 to ensure that the end 627 of each display data frame 604 is in sync with the end 628 of each display frame 606. For example, display control circuitry 514 may operate internal oscillator 517 and counter 518 to determine a number of oscillator counts (see, e.g., counts 624A, 624B, and 624C) corresponding to the display 1H time 622 for each pixel row 601 based on a current-row count for that pixel row as referenced to a system 1H time. Current-row counts for each pixel row may be determined by counter 518 based on the timing signal from internal oscillator 517.

Display control circuitry 514 may operate internal oscillator 517 and counter 520 to maintain a current-frame count that indicates a number of counts accumulated during a current display frame 606. The current-frame count may be used to determine an actual completed-row count (see, e.g., counts 626A, 626B, and 626C) and a reference completed-row count, during operation of each pixel row, for all of the previously completed pixel rows of the current display frame 606.

Display control circuitry 514 may determine corrected reference current-row counts for the display 1H time for each pixel row based on the reference current-row count and a comparison of the reference completed-row count and the actual completed-row count as described in further detail below in connection with FIGS. 7 and 8. Corrected reference current-row counts may be used to help reduce accumulated effects of oscillator errors in determining the 1H time for each pixel row and, in this way, calibrate the row/line time of the display to the row/line time of the received display data so that a frame time of the received display data matches an actual displayed frame time.

Display control circuitry 514 may operate counter 520 to accumulate and maintain the current-frame count through the end 630 of data display period 612 of each frame 606. In some implementations, the expected current-frame count may not be accumulated in vertical blanking period 614 of each display frame 606 to avoid errors that may be caused by system clock operations during the vertical blanking period.

In the example of FIG. 6, the display 1H time is 6.76 microseconds, the vertical blanking period is 28 1H times, and pixel array 500 includes 2436 pixel rows with the internal oscillator operating at a frequency of 82.7 megahertz. However, this is merely illustrative and other array sizes, display 1H times, frequencies, and vertical blanking periods can be used as would be understood by one of ordinary skill in the art.

Figure 7:
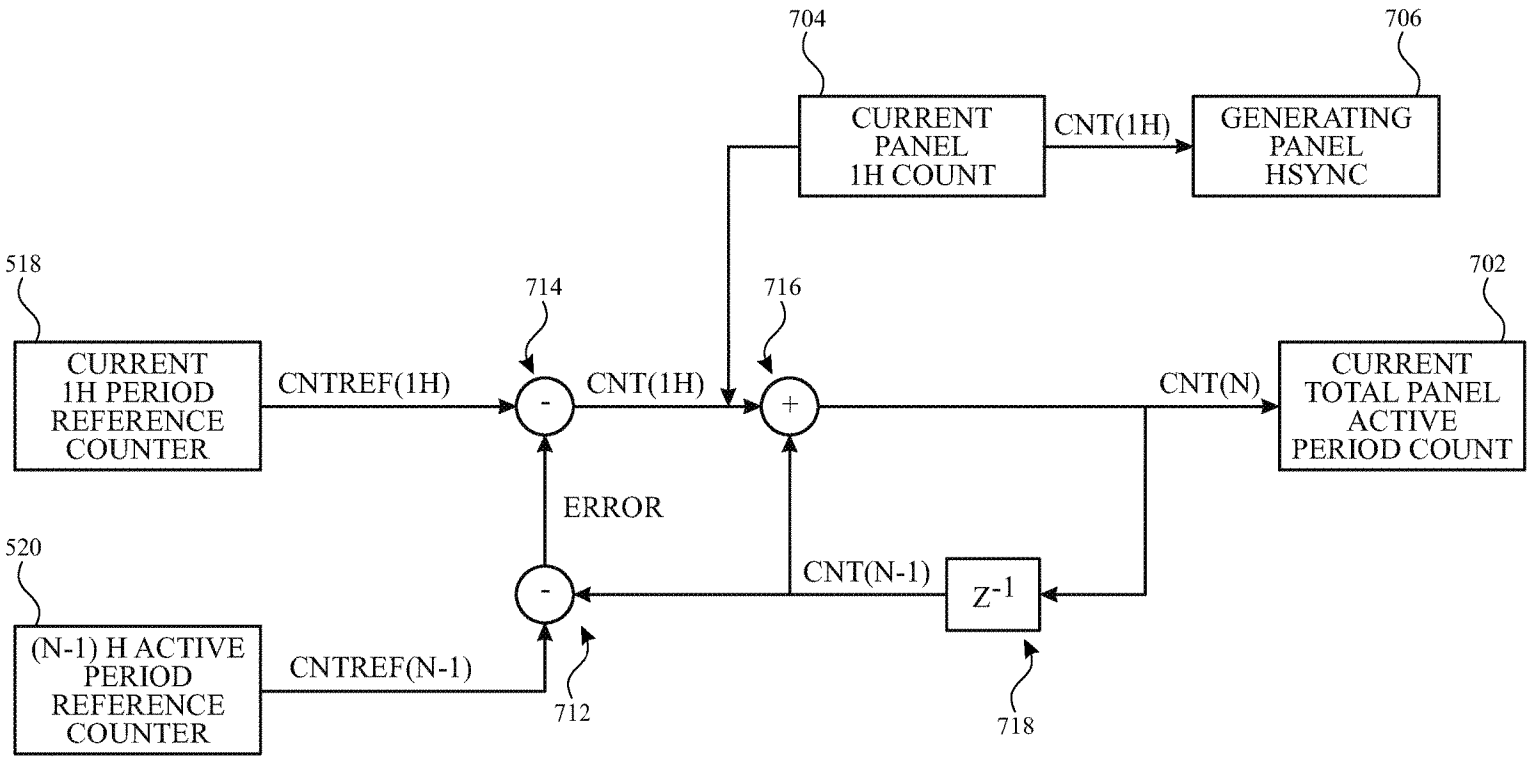
FIG. 7 illustrates a schematic data flow diagram for calibrated display timing in accordance with various aspects of the subject technology.

Various operations that may be performed by display control circuitry 514 for calibrating the display 1H time (the display line time) to the system 1H time (the system line time) are shown in FIG. 7. As shown, counter 518 may be a current 1H period reference counter. Counter 518 may maintain, based on an output of the internal oscillator, during operation of each current pixel row a current-row count that indicates an accumulated number of counts since the beginning of the operation of the current pixel row (e.g., an Nth pixel row). The current-row count at the end of a display data pixel row 601 may be assumed to be the number of counts corresponding to the system line time. A ratio of the display line time to the system line time may be multiplied by the number of counts corresponding to the system line time to obtain a reference current-row count CNTREF(1H) corresponding to the number of counts of counter 518 at which operation of the current pixel row should end.

Counter 520 may be an (N−1)H active period reference counter that maintains, during operation of each pixel row, a current-frame count that that indicates an accumulated number of counts of the second counter since the beginning of the current frame. The current-frame count at the end of a previous display data pixel row 601 may be assumed to be the number of counts corresponding to the sum of the system line times for all previous data pixel rows. A ratio of the display line time to the system line time may be multiplied by the number of counts corresponding to the sum of the system line times for all previous data pixel rows to obtain a reference completed-row count CNTREF(N−1) corresponding to the number of counts of counter 520 at which operation of the previous pixel row should have ended. The reference completed-row count CNTREF(N−1) may thus indicate an expected number of counts accumulated while operating all previous pixel rows (e.g., pixel rows 1-(N−1)) during the current display frame.

A current total panel active period count CNT(N), which is sometimes referred to herein as the current actual current-frame count 702 may be stored during operation of each pixel row. An actual completed-row count CNT(N−1) that indicates a number of counts accumulated while operating all previous pixel rows during the current display frame (e.g., pixel rows 1-(N−1)) may also be determined (718) (e.g., based on the actual number of counts of counter 520 at the end of the previous pixel row).

As shown in FIG. 7, a correction value or error may be determined by comparing (712) the actual completed-row count CNT(N−1) (see 718) with the reference completed-row count CNTREF(N−1) (e.g., by subtraction of one of actual completed-row count CNT(N−1) and the reference completed-row count CNTREF(N−1) from the other). The determined correction value may be applied (714) to the reference current-row count CNTREF(1H) to determine a corrected reference current-row count CNT(H). The corrected reference current-row count CNT(1H) may be stored as a current panel 1H count 704 and provided for generating (706) a panel horizontal synchronization (HSYNC) signal to end operation of the current pixel row and begin operation of a subsequent pixel row. For example, the HSYNC signal may be provided when the current-row count from counter 518 reaches the corrected reference current-row count. The corrected reference current-row count CNT(1H) or the number of counts from counter 518 at the end of the current pixel row may be added (716) to the actual completed-row count CNT(N−1) (see 718) to update the actual current-frame count CNT(N). The operations of FIG. 7 may be used to dynamically adjust a next 1H count during an active period, according to a current total active period count until, for example, reaching the last pixel row. It should also be appreciated that the specific operations described in connection with FIG. 7 are merely illustrative and other operations may be performed to calibrate a display line time to a system line time using (a) a reference current-row count, (b) a reference current-frame count, and (c) a known system line time to display line time ratio.

In the example of FIGS. 6 and 7, an accumulated error in the total active period may be reduced to less than 3 1H times or less than 3 parts per million (e.g., assuming that no abrupt temperature changes occur in the local oscillator during a display frame and that a maximum overall error generated by counters 518 and 520 is three clock oscillations).

Figure 8:
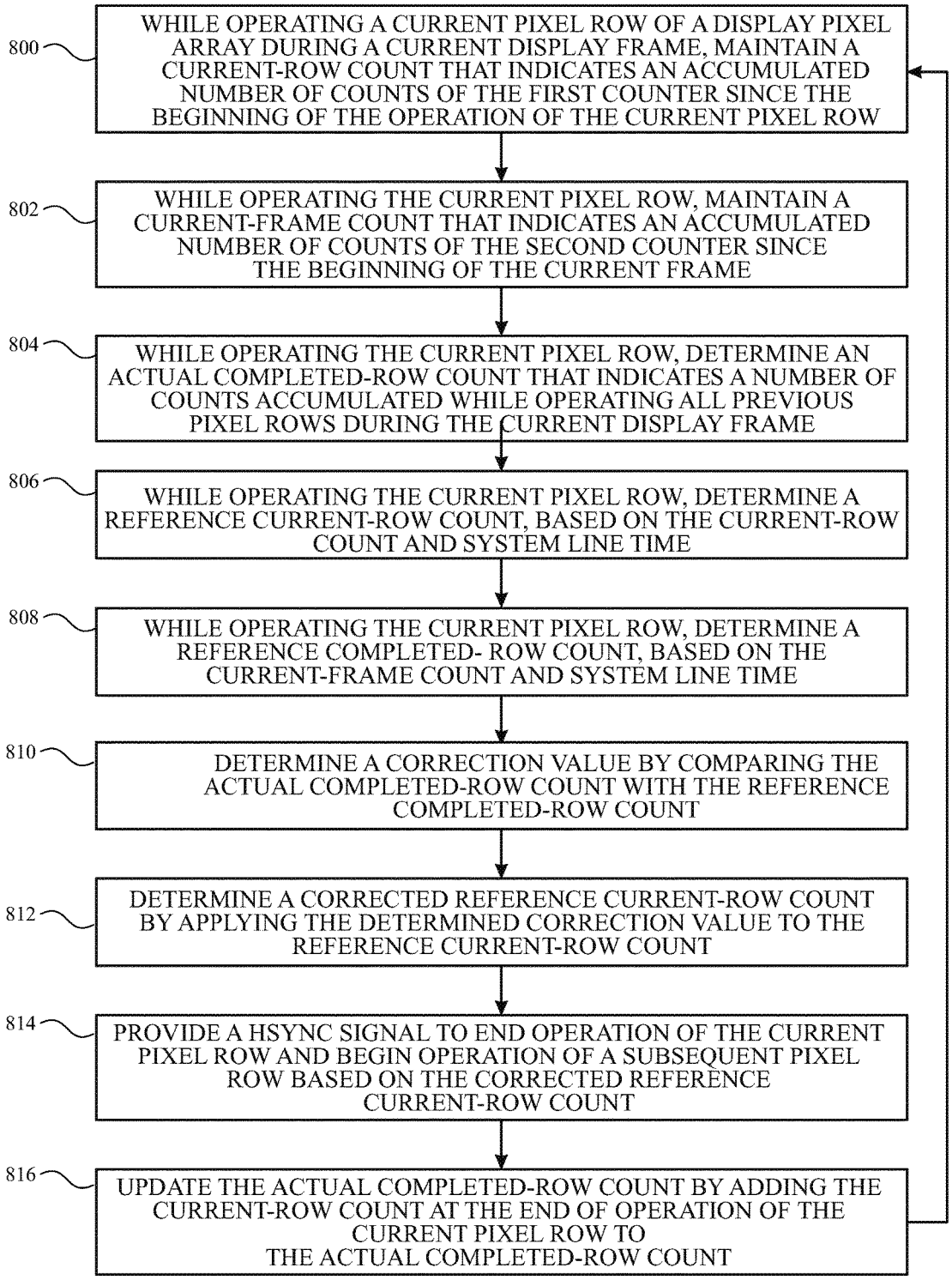
FIG. 8 illustrates a flow chart of an example process for calibrated display timing in accordance with various aspects of the subject technology.

FIG. 8 depicts a flow diagram of an example process for component life management, according to aspects of the subject technology. For explanatory purposes, the example process of FIG. 8 is described herein with reference to the components of FIGS. 1-7. Further for explanatory purposes, the blocks of the example process of FIG. 8 are described herein as occurring in series, or linearly. However, multiple blocks of the example process of FIG. 8 may occur in parallel. In addition, the blocks of the example process of FIG. 8 need not be performed in the order shown and/or one or more of the blocks of the example process of FIG. 8 need not be performed.

In the depicted example flow diagram, at block 800, while operating a current pixel row of a display pixel array 500 during a current display frame (see, e.g., display frames 606 of FIG. 6) using display control circuitry 514, a current-row count that indicates an accumulated number of counts since the beginning of the operation of the current pixel row may be maintained (e.g., by operating first counter 518 and internal oscillator 517 of display control circuitry 514).

At block 802, while operating the current pixel row during the current display frame, a current-frame count (e.g., CNT(N) of FIG. 7) that indicates an accumulated number of counts since the beginning of the current frame may be maintained (e.g., by operating second counter 520 and internal oscillator 517 of display control circuitry 514).

At block 804, while operating the current pixel row during the current display frame, an actual completed-row count (e.g., CNT(N−1) of FIG. 7) that indicates a number of counts accumulated while operating all previous pixel rows during the current display frame may be determined. The actual completed-row count may be determined based on the current-frame count at the end of operation of the previous pixel row during the current display frame.

At block 806, while operating the current pixel row during the current display frame, a reference current-row count (e.g., CNTREF(1H) of FIG. 7) may be determined based on the current-row count and a system line time for the current pixel row. For example, the reference current-row count may be determined by determining a number of counts of the first counter during a display data pixel row and applying a conversion ratio to the number of counts of the first counter during the display data pixel row (e.g., by multiplying the number of counts of the first counter during the display data pixel row by the ratio of the known display line time (display 1H time) to the known system line time (system 1H time)).

At block 808, while operating the current pixel row during the current display frame, a reference completed-row count (e.g., CNTREF(N−1) of FIG. 7) may be determined based on the current-frame count and the system line time. For example, the reference completed row count may be determined by determining a number of counts of the second counter during all previous display data pixel rows and applying the conversion ratio to the number of counts of the second counter during all previous display data pixel rows (e.g., by multiplying the number of counts of the second counter during all previous display data pixel rows by the ratio of the known display line time (display 1H time) to the known system line time (system 1H time)).

At block 810, a correction value or correction factor (e.g., "error" of FIG. 7) may be determined by comparing the actual completed-row count with the reference completed-row count. Comparing the actual completed-row count with the reference completed-row count may include subtracting the actual completed-row count from the reference completed-row count or vice versa.

At block 812, a corrected reference current-row count (e.g., CNT(1H) of FIG. 7) may be determined by applying the determined correction value to the reference current-row count. For example, applying the determined correction value to the reference current-row count may include subtracting the correction value from the reference current-row count. In this way, the corrected reference current-row count can be determined based on the current-row count, the actual completed-row count, and the reference completed-row count.

At block 814, a horizontal synchronization (HSYNC) signal may be provided to end operation of the current pixel row and begin operation of a subsequent pixel row based on the corrected reference current-row count. For example, the HSYNC signal may be provided when the current-row count from the first counter reaches the corrected reference current-row count. In this way, operation of the current pixel row may be completed for the current frame and operation of a subsequent pixel row for the current frame may begin based on the corrected reference current-row count.

At block 816, the actual completed-row count may be updated by adding the current-row count at the end of operation of the current pixel row to the actual completed-row count. As indicated in FIG. 8, following the operations of blocks 814 and 816, the operations 800-816 may be repeated with the subsequent pixel row becoming the current pixel row. For example, the first counter may be reset and used (e.g., in a subsequent instance of block 800) to maintain a new current-row count during operation of the subsequent pixel row. During operation of the subsequent pixel row (e.g., in a subsequent instance of block 802), the current-frame count may continue to be maintained without resetting the second counter. The second counter may be reset at the end of the data period 612 for the current frame and/or at the end 630 of the display frame.

Various functions described above can be implemented in digital electronic circuitry, in computer software, firmware or hardware. The techniques can be implemented using one or more computer program products. Programmable processors and computers can be included in or packaged as mobile devices. The processes and logic flows can be performed by one or more programmable processors and by one or more programmable logic circuitry. General and special purpose computing devices and storage devices can be interconnected through communication networks.

Some implementations include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, ultra density optical discs, any other optical or magnetic media, and floppy disks. The computer-readable media can store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some implementations are performed by one or more integrated circuits, such as application specific integrated circuits (ASICs) or field programmable gate arrays (FPGAs). In some implementations, such integrated circuits execute instructions that are stored on the circuit itself.

As used in this specification and any claims of this application, the terms "computer", "processor", and "memory" all refer to electronic or other technological devices. These terms exclude people or groups of people. For the purposes of the specification, the terms "display" or "displaying" means displaying on an electronic device. As used in this specification and any claims of this application, the terms "computer readable medium" and "computer readable media" are entirely restricted to tangible, physical objects that store information in a form that is readable by a computer. These terms exclude any wireless signals, wired download signals, and any other ephemeral signals.

To provide for interaction with a user, implementations of the subject matter described in this specification can be implemented on a computer having a display device as described herein for displaying information to the user and a keyboard and a pointing device, such as a mouse or a trackball, by which the user can provide input to the computer. Other kinds of devices can be used to provide for interaction with a user as well; for example, feedback provided to the user can be any form of sensory feedback, such as visual feedback, auditory feedback, or tactile feedback; and input from the user can be received in any form, including acoustic, speech, or tactile input.

Many of the above-described features and applications are implemented as software processes that are specified as a set of instructions recorded on a computer readable storage medium (also referred to as computer readable medium). When these instructions are executed by one or more processing unit(s) (e.g., one or more processors, cores of processors, or other processing units), they cause the processing unit(s) to perform the actions indicated in the instructions. Examples of computer readable media include, but are not limited to, CD-ROMs, flash drives, RAM chips, hard drives, EPROMs, etc. The computer readable media does not include carrier waves and electronic signals passing wirelessly or over wired connections.

In this specification, the term "software" is meant to include firmware residing in read-only memory or applications stored in magnetic storage, which can be read into memory for processing by a processor. Also, in some implementations, multiple software aspects of the subject disclosure can be implemented as sub-parts of a larger program while remaining distinct software aspects of the subject disclosure. In some implementations, multiple software aspects can also be implemented as separate programs. Finally, any combination of separate programs that together implement a software aspect described here is within the scope of the subject disclosure. In some implementations, the software programs, when installed to operate on one or more electronic systems, define one or more specific machine implementations that execute and perform the operations of the software programs.

A computer program (also known as a program, software, software application, script, or code) can be written in any form of programming language, including compiled or interpreted languages, declarative or procedural languages, and it can be deployed in any form, including as a stand alone program or as a module, component, subroutine, object, or other unit suitable for use in a computing environment. A computer program may, but need not, correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

It is understood that any specific order or hierarchy of blocks in the processes disclosed is an illustration of example approaches. Based upon design preferences, it is understood that the specific order or hierarchy of blocks in the processes may be rearranged, or that all illustrated blocks be performed. Some of the blocks may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the subject disclosure.

The predicate words "configured to", "operable to", and "programmed to" do not imply any particular tangible or intangible modification of a subject, but, rather, are intended to be used interchangeably. For example, a processor configured to monitor and control an operation or a component may also mean the processor being programmed to monitor and control the operation or the processor being operable to monitor and control the operation. Likewise, a processor configured to execute code can be construed as a processor programmed to execute code or operable to execute code A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as a "configuration" does not imply that such configuration is essential to the subject technology or that such configuration applies to all configurations of the subject technology. A disclosure relating to a configuration may apply to all configurations, or one or more configurations. A phrase such as a configuration may refer to one or more configurations and vice versa.

The word "example" is used herein to mean "serving as an example or illustration." Any aspect or design described herein as "example" is not necessarily to be construed as preferred or advantageous over other aspects or design All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. An electronic device having a display with an array of display pixels arranged in pixel rows and pixel columns, the electronic device comprising:

display control circuitry configured to operate the array of display pixels to display a plurality of display frames, wherein the display control circuitry comprises:

an internal oscillator;

a first counter configured to maintain, based on an output of the internal oscillator, a current-row count during operation of a current one of the pixel rows for a current display frame; and a second counter configured to maintain, based on the output of the internal oscillator, a current-frame count during operation of all of the pixel rows for the current display frame, wherein an operation of a current pixel row and a beginning operation of a subsequent pixel row is completed based on a corrected reference current-row count, the corrected reference current-row count being based on the current-row count and the current-frame count.

2. The electronic device of claim 1, wherein, during operation of the current one of the pixel rows, the display control circuitry is further configured to:

receive display data for the current display frame from external circuitry, the display data having a system line time;

determine a reference current-row count based on the current-row count and the system line time;

determine a reference completed-row count for all of the pixel rows operated prior to the current pixel row for the current display frame, based on the current-frame count and the system line time; and determine an actual completed-row count corresponding to a number of counts accumulated during operation of all of the pixel rows operated prior to the current pixel row for the current display frame.

3. The electronic device of claim 2, wherein the display control circuitry is further configured to determine a correction factor for the reference current-row count by comparing the reference completed-row count with the actual completed-row count.

4. The electronic device of claim 3, wherein the display control circuitry is further configured to determine the corrected reference current-row count by applying the correction factor to the reference current-row count.

5. The electronic device of claim 4, wherein the display control circuitry is further configured to generate a horizontal synchronization signal when the current-row count reaches the corrected reference current-row count to end operation of the current pixel row and begin operation of a subsequent pixel row.

6. The electronic device of claim 4, wherein the system line time of the display data is different from a display line time of the display, and wherein the display control circuitry is configured to determine the reference current-row count and the reference completed-row count based on a ratio of the display line time to the system line time.

7. The electronic device of claim 6, wherein the corrected reference current-row count is configured to calibrate the display line time of the display to the system line time of the display data so that a frame time of the display data matches an actual displayed frame time.

8. The electronic device of claim 1, wherein the display control circuitry comprises a display driver integrated circuit.

9. The electronic device of claim 1, wherein the electronic device comprises a cellular telephone or a tablet computer.

10. The electronic device of claim 1, wherein the array of display pixels comprises an array of organic light emitting, diode display pixels.

11. A display controller for controlling an array of display pixels, arranged in pixel rows and pixel columns, to display a plurality of display frames, the display controller comprising:

an internal oscillator;

a first counter configured to maintain, based on an output of the internal oscillator, a current-row count during operation of a current one of the pixel rows for a current display frame; and a second counter configured to maintain, based on the output of the internal oscillator, a current-frame count during operation of all of the pixel rows for the current display frame, wherein an operation of a current pixel row and a beginning operation of a subsequent pixel row is completed based on a corrected reference current-row count, the corrected reference current-row count being based on the current-row count and the current-frame count.

12. The display controller of claim 11, wherein the display controller is configured to:

receive display data for the current display frame from external circuitry, the display data having a system line time;

determine a reference current-row count based on the current-row count and the system line time;

determine a reference completed-row count for all of the pixel rows operated prior to the current pixel row for the current display frame, based on the current-frame count and the system line time; and determine an actual completed-row count corresponding to a number of counts accumulated during operation of all of the pixel rows operated prior to the current pixel row for the current display frame.

13. The display controller of claim 12, wherein the display controller is further configured to:

determine a correction factor for the reference current-row count by comparing the reference completed-row count with the actual completed-row count; and determine the corrected reference current-row count by applying the correction factor to the reference current-row count.

14. The display controller of claim 13, wherein the display controller is further configured to generate a horizontal synchronization signal based on the reference corrected current-row count to end operation of the current pixel row and begin operation of a subsequent pixel row.

15. The display controller of claim 11, wherein the array of display pixels comprises an array of organic light emitting diode display pixels.

16. A method, comprising:

operating an array of display pixels arranged in pixel rows and pixel columns to display a current display frame, based on display data having a system line time;

maintaining, while operating a current pixel row of the array of,display pixels during the current display frame, a current-row count that indicates an accumulated number of counts since a beginning of the operation of the current pixel row;

maintaining, while operating the current pixel row, a current-frame count that indicates an accumulated number of counts since a beginning of the current display frame;

determining, while operating the current pixel row, an actual completed-row count that indicates a number of counts accumulated while operating all previous pixel rows during the current display frame;

determining, while operating the current pixel row, a reference current-row count based on the current-row count and the system line time;

determining, while operating the current pixel row and based on the system line time, a reference completed-row count that indicates an expected number of counts accumulated while operating all previous pixel rows during the current display frame;

determining a corrected reference current-row count based on the reference current-row count, the actual completed-row count, and the reference completed-row count; and completing operation of the current pixel row and beginning operation of a subsequent pixel row based on the corrected reference current-row count.

17. The method of claim 16, wherein determining the corrected reference current-row count based on the current-row count, the actual completed-row count, and the reference completed-row count comprises:

determining a correction value by comparing the actual completed-row count with the reference completed-row count; and determining the corrected reference current-row count by applying the correction value to the reference current-row count.

18. The method of claim 16, further comprising updating the actual completed-row count by adding the current-row count at an end of operation of the current pixel row to the actual completed-row count.

19. The method of claim 18, wherein maintaining the current-row count comprises operating a first counter, wherein maintaining the current-frame count comprises operating a second counter, and wherein the method further comprises:

resetting the first counter and maintaining a new current-row count during operation of the subsequent pixel row.

20. The method of claim 19, further comprising:

maintaining the current-frame count during operation of the subsequent pixel row by continuing to operate the second counter without resetting the second counter.

* * * * *